United States Patent [19]

Batch

[11] 4,165,044

[45] Aug. 21, 1979

[54] JAW CRUSHER HAVING WEDGES FOR TOGGLE BEAM

[75] Inventor: Joseph Batch, Milwaukee, Wis.

[73] Assignee: Barber-Greene Company, Aurora, Ill.

[21] Appl. No.: 894,717

[22] Filed: Apr. 10, 1978

[51] Int. Cl.[2] ..... B02C 1/04

[52] U.S. Cl. ..... 241/264; 241/285 R

[58] Field of Search ..... 241/262, 269, 285 R

[56] References Cited

U.S. PATENT DOCUMENTS

| | | | |
|---|---|---|---|
| 2,865,570 | 12/1958 | Nutting | 241/266 X |
| 3,166,259 | 1/1965 | Archer et al. | 241/267 X |
| 3,473,744 | 10/1969 | DeDiemar | 241/267 X |

*Primary Examiner*—Howard N. Goldberg
*Attorney, Agent, or Firm*—James E. Nilles

[57] ABSTRACT

A jaw crusher for the reduction of rock and ore and including a toggle beam and a transversely shiftable wedge at each end of the beam whereby the toggle beam is wedged downwardly into position in the way slots of the crusher side walls and locked therein. Means are provided between the beam ends and the wedges for shifting the wedges in beam locking and unlocking directions. Lifting of these extremely heavy toggle beams is not necessary in order to effect their removal.

16 Claims, 13 Drawing Figures

JAW CRUSHER HAVING WEDGES FOR TOGGLE BEAM

BACKGROUND OF THE INVENTION

Prior art jaw crushers of the type to which the invention generally pertains are shown in U.S. Pat. No. 3,984,058, issued Oct. 5, 1976 and entitled "Means for Holding Dies in a Jaw Crusher;" U.S. Pat. No. 3,473,744 issued Oct. 21, 1969, entitled "Jaw Crusher Adjustment;" and U.S. Pat. No. 3,166,259 issued Jan. 19, 1965, entitled "Jaw Crusher." All of these patents have been assigned to an assignee common with the present invention. These patents all utilize toggle beams which are adjusted to vary the crushing space between a movable jaw and a fixed jaw in such a crusher. If these beams become loose, they shift and cause considerable wear and move erratically to cause malfunction of the crusher. These prior art devices also all use toggle plates between the lower end of the swingable jaw and the toggle beam and furthermore also utilize tension rod and spring assemblies for retaining the toggle plate in position. These prior art devices work entirely satisfactorily and have met with considerable commercial success. However, with the advent of much large jaw crushers, it is extremely difficult to move the extremely large and heavy toggle beam, secure them in place once they have been adjusted, or remove the beam. Heretofore, it has been necessary to lift these beams in order to remove them, and with the advent of these larger machines, this has become practically impossible to do.

SUMMARY OF THE INVENTION

The present invention provides a jaw crusher including a swingable jaw which is connected with a toggle beam and which has wedges for urging the toggle beam downwardly into its adjusted position so that it can then be locked therein. With the present invention, there is no need to lift the toggle beam, but instead, it is pushed downwardly and wedged into its position so as to eliminate any space or looseness between the various parts. The beam is then locked in tightly between the beam members. The invention also contemplates the use of means to forcibly lock the wedges in place or remove them when necessary.

These and other objects and advantages of the present invention will appear hereinafter as this disclosure progresses, reference being had to the accompanying drawings.

DESCRIPTION OF THE INVENTION

Figure 3:
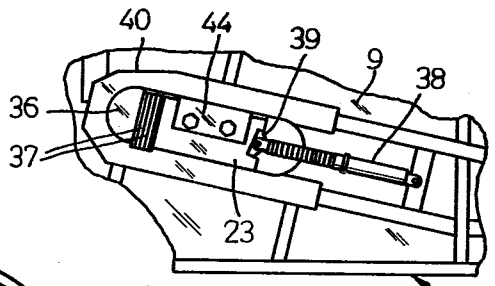
FIG. 3 is a fragmentary, elevational view of a portion of the crusher shown in FIG. 1, the view being taken along the line 3—3 in FIG. 2.

Referring to the drawings, the jaw crusher shown therein as embodying the invention comprises, in general, a main frame 8 having side walls 9 suitably secured thereto in parallel spaced relation to provide a housing for a stationary jaw die 10 and a movable jaw die 11. The stationary jaw die may be rigidly secured to the main frame 8 in a suitable manner as by means of bolts 12, and the movable jaw die 11 is normally secured within a recess formed in the face of the swinging jaw frame 13 as by means of bolts 15. The swinging jaw frame 13 is suspended at its upper end from an eccentric shaft 16. The eccentric 16 is driven in a well known manner through a grooved sheave 19 and a suitable drive motor, not shown.

Adjacent its lower end, the movable jaw frame 13 is rockably fulcrumed upon a toggle plate 22 extending transversely across the rear of the jaw frame between the crusher side walls 9, the toggle plate 22 in turn being fulcrumed on a toggle beam 23. The toggle beam 23 is of a length somewhat greater than the width of the housing and has its opposite ends extending through aligned elongated openings or slots 24 in the side walls 9, the slots 24 forming adjustment ways within which the toggle beam is guided to different positions of adjustment as will hereinafter be more fully described.

Figure 1:
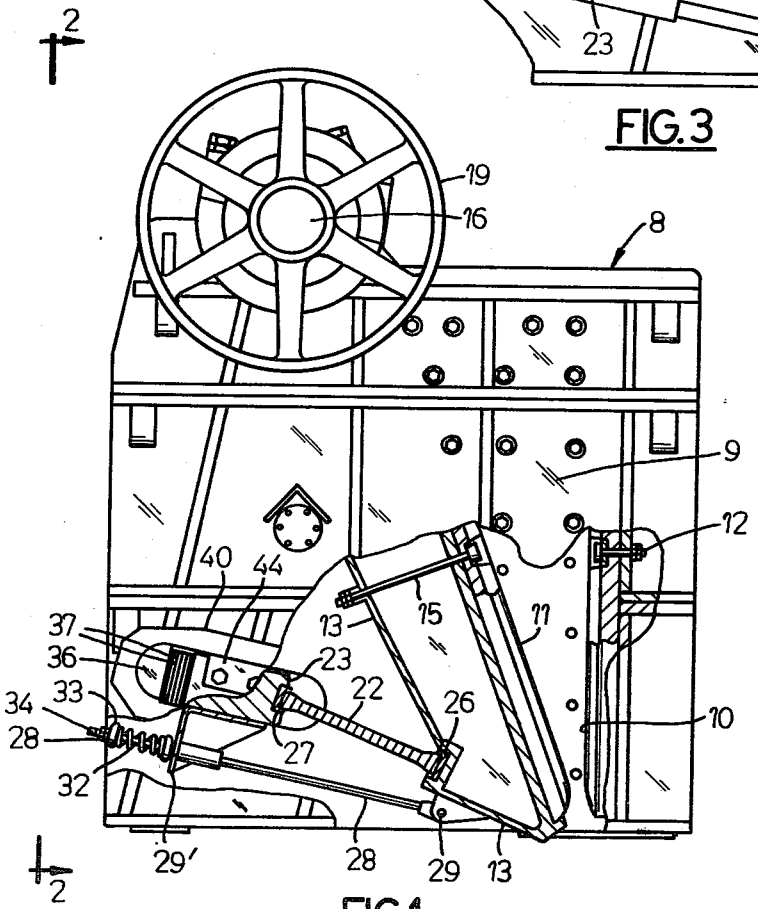
FIG. 1 is a side elevational view of a jaw crusher embodying the present invention, certain parts being shown as broken away or in section for the sake of clarity.
Figure 2:
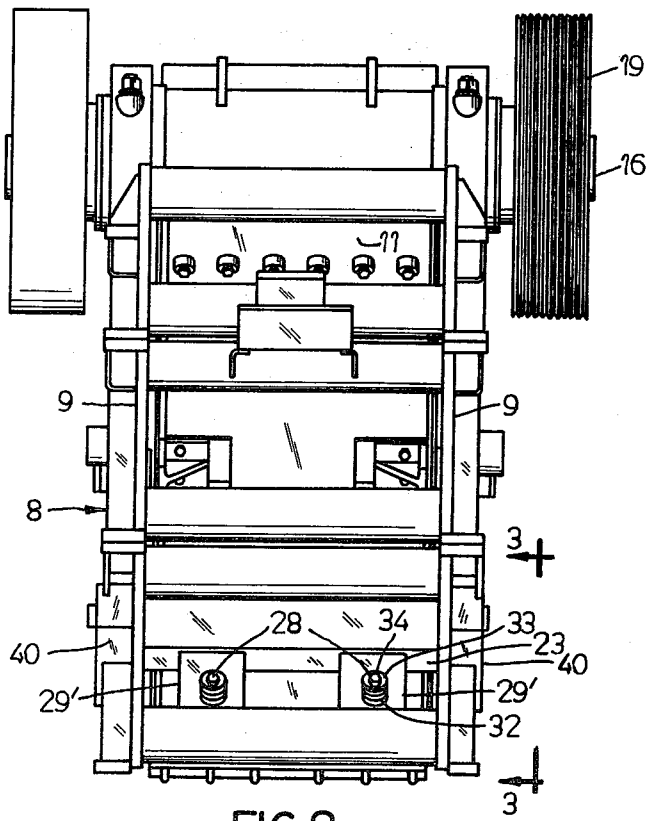
FIG. 2 is an elevational view of the crusher shown in FIG. 1, the view being taken generally from the line 2—2 in FIG. 1.
Figure 4:
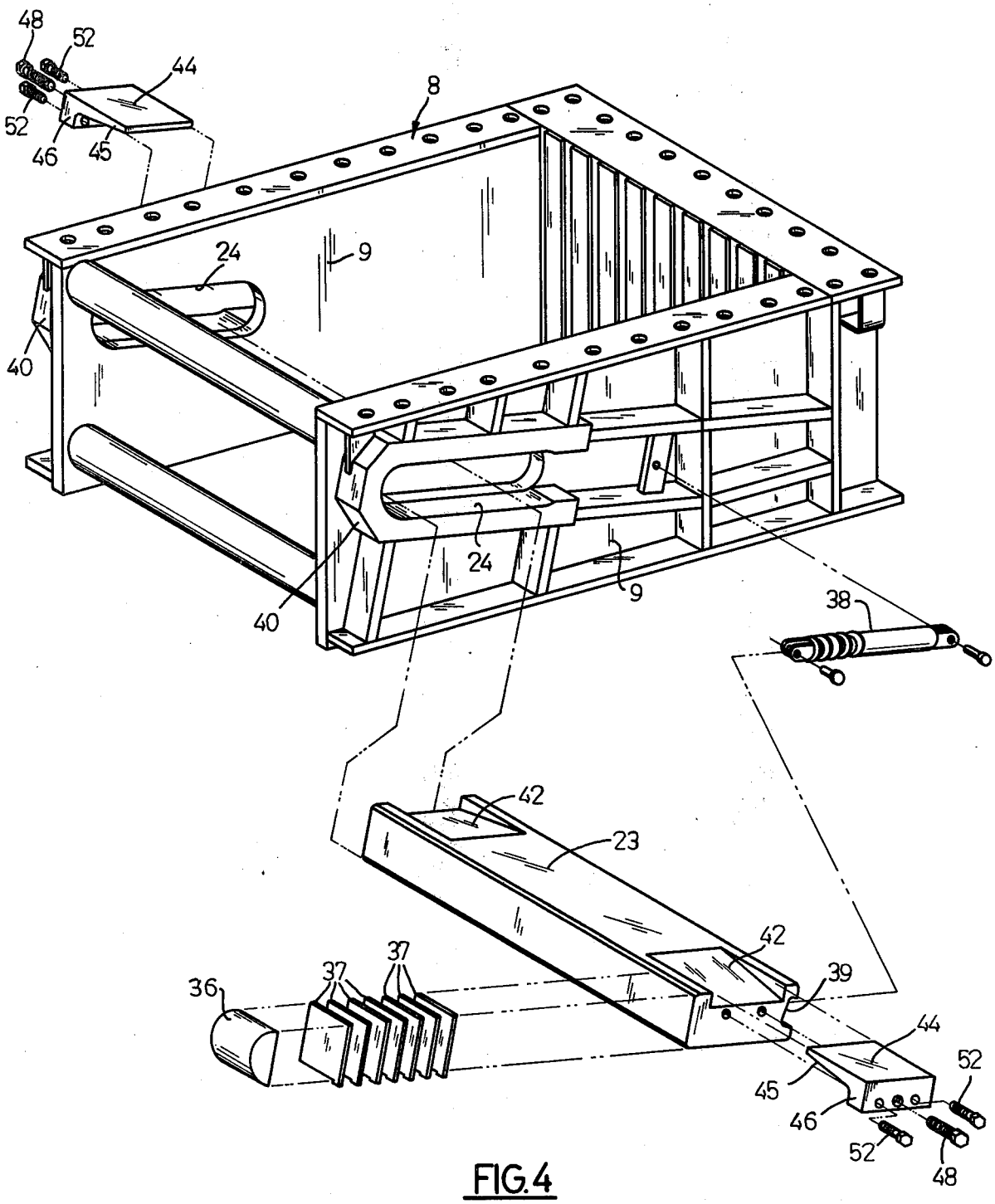
FIG. 4 is a perspective, exploded view of certain of the parts of the crusher shown in FIG. 1.

To retain the ends of the toggle or toggle plate 22 within its toggle seats 26 and 27 provided at the lower end of the movable jaw frame 13 and at the forward end of the toggle beam 23 respectively, a pair of tension rod and spring assemblies are provided. As shown, the tension rod and spring assemblies each comprise a tension rod 28 pivotally secured at 29 to the jaw frame 13 and having its opposite end suspended from and carried by the toggle beam 23. As shown in FIG. 1, a bracket 29' is secured to the toggle beam 23 as by cap screws (not shown), and the free end of the tension rod 28 extends through an aperture in the bracket 29' and is embraced by a coil spring 32 which is compressed between a pair of washers 33 retained in adjusted position by means of lock nuts 34 at the end of the tension rod 28. Since the spring and tension rod assembly thus provided is carried entirely by the toggle beam and movable jaw, this assembly moves with the toggle beam 23 and jaw 13 as adjustments are effected.

As hereinabove indicated, the ends of the toggle beam 23 extend through the slots 24 in the side walls 9, and the position of the toggle beam within the way slots 24 may be adjusted by means of a spacer block 36 and shims 37 placed between the toggle beam 23 and the rearward end of each way slot. To move the relatively heavy toggle beam 23 together with the toggle plate 22 and lower end of the rockable jaw 13 to different positions of adjustment for insertion or removal of the shims 37, an actuator such as a power actuator in the form of a double acting hydraulic ram 38 is provided at each end of the toggle beam exteriorly of the housing side wall 9. The actuator 38 is secured to the toggle seat 39 located in the end of the beam in the conventional manner. Since the adjustment shims and power actuators at both ends of the toggle beam 23 are identical, with the power cylinders being coupled together for simultaneous actuation in a well-known manner, only one end of the toggle beam and its attendant adjustment mechanism has been illustrated in the drawings, it being understood that the other end of the beam 23 is provided with identical structure.

The side walls 9 each have a generally U-shaped reinforcing flange 40 on the outside of the wall and surrounding the way slot and forming a part thereof. The flange is welded to the side wall in the conventional manner.

The ends of the beam each have a tapered, recessed surface 42 formed therein and which complement a wedge 44. More specifically, the wedge 44 has a lower tapered surface 45 which slides on and abuts against the beam surface 42 and also has a downwardly extending portion 46 located transversely outwardly of the end of the beam. Wedges 44 are adapted to be inserted in a transverse direction of the crusher and between the beam ends and the end walls, and forcing the wedge inwardly acts to force the beam 23 downwardly against the side wall 9 and into tight engagement in the way slot 24. The wedges 44 take up any slack or space between the end walls and the beam, thus securely locking the beam in position. To fix the beam in place, the wedge acts to push the beam downwardly and there is no need to lift the beam at any time in order to adjust or remove it.

FIGS. 5-7

Figure 5:
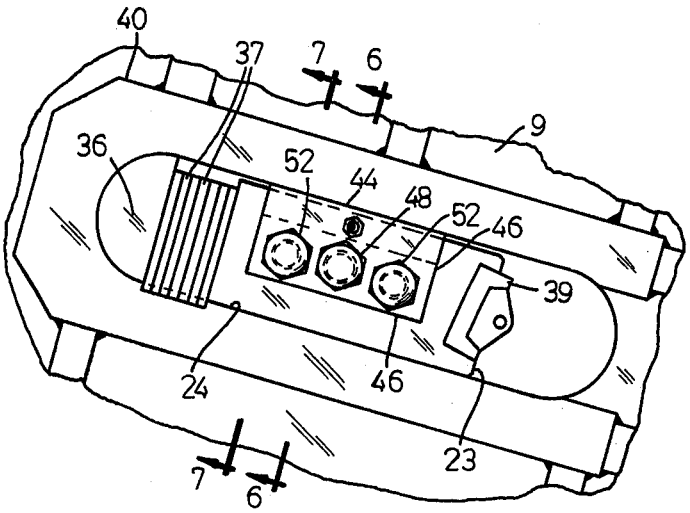
FIG. 5 is a view similar to FIG. 3, but in greater detail and on an enlarged scale.
Figure 6:
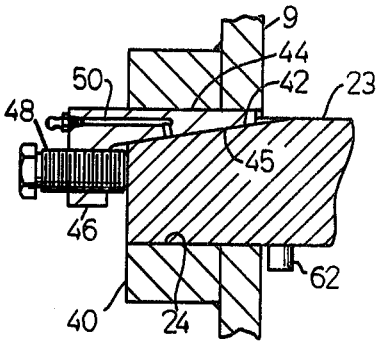
FIG. 6 is a sectional view taken generally along the line 6—6 in FIG. 5.
Figure 7:
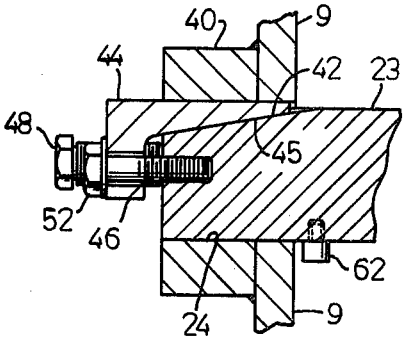
FIG. 7 is another sectional view taken generally along the line 7—7 in FIG. 5.
Figure 9:
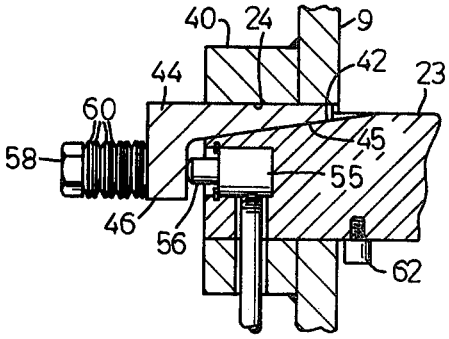
FIG. 9 is a sectional view taken generally along the line 9—9 in FIG. 8.
Figure 8:
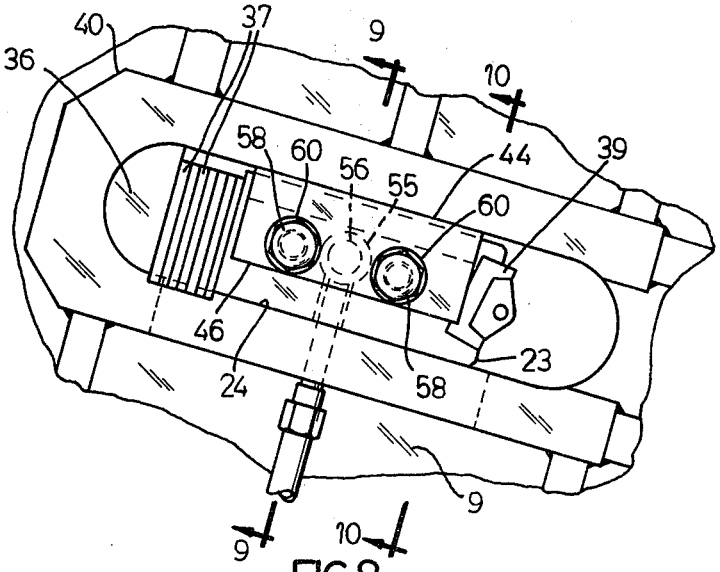
FIG. 8 is a view similar to FIG. 5, but showing a modified form of the invention.

Means are also provided for forceably removing the wedge from the beam. To remove the beam, it is only necessary to remove bolts 52 (FIGS. 5 and 7) and then tighten bolt 48 against the beam, causing the wedge to be removed. More specifically, the threaded bolt 48 is threadably engaged in the downwardly extending portion 46 of the wedge, the inner end of the bolt 48 bears against the end of the beam, and simply turning the bolt 48 so as to move it into the wedge, causes the wedge to be pulled transversely from the way slot. A lubricating passage 50 may also be provided for facilitating removal of the wedge.

Wedge-securing means are provided for also forceably inserting the wedge into tight wedging engagement between the wall and the beam, and this means includes the threaded bolts 52 which are threadably engaged in the end of the beam and which pass freely through the downwardly extending portion 46 of the wedge. By turning the bolts 52 so as to threadably engage in the beam, the wedge is forced into wedging engagement to securely lock it in place.

FIGS. 8-10

Figure 10:
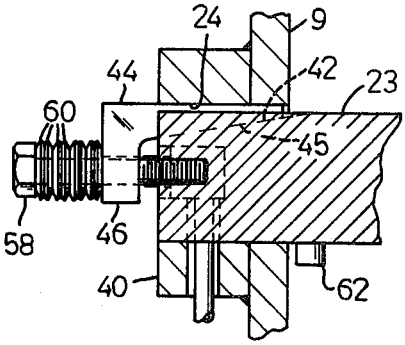
FIG. 10 is another sectional view taken generally along the line 10—10 in FIG. 8.

These views show a modified form for forceably withdrawing the wedge or for forcing it into wedging position. More specifically, a hydraulic actuated ram 55 is located in the end of the beam and the ram includes a rod 56 extending from the end of the beam and which abuts against the downwardly extending portion of the wedging. Pressure fluid is introduced into the ram 55, the piston 56 extends, thereby acting against the wedging causing it to be moved in the withdrawing direction. As shown in FIG. 10, wedge-securing means are provided in the form of bolts 58 threadably engaged in the end of the beam and passing freely through the downwardly extending portion of the wedge. A series of Belleville springs 60 are located on the bolts 58 between its head and the wedge and these Belleville springs when compressed, as when the bolt 58 is threadably engaged tightly in the beam, cause the wedge to be urged in a transverse direction into tight wedging engagement in the way slot between the wall and the beam. A keeper bolt 62 is inserted in the beam on the inside of the wall 9 and is removed prior to removal of the beam.

To loosen or remove the wedge, it is only necessary to loosen the spring-loaded bolts 58 and then actuate the fluid ram 55 and cause withdrawal of the wedge.

FIGS. 11-13

Figure 11:
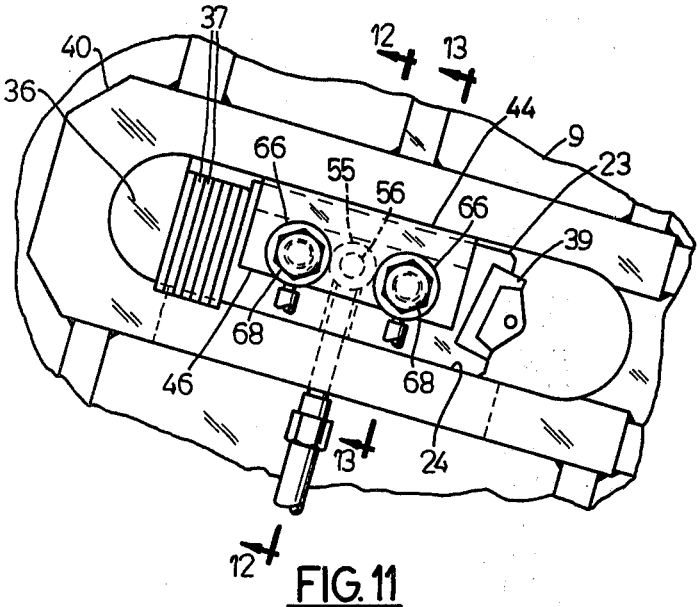
FIG. 11 is a view similar to FIG. 8, but showing another modified form of the invention.
Figure 12:
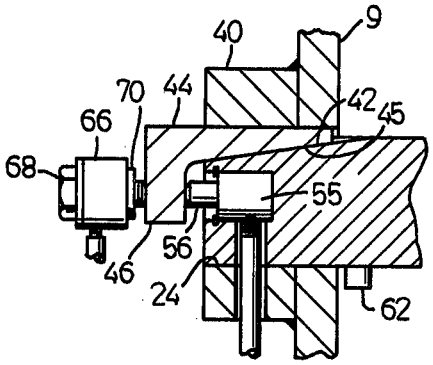
FIG. 12 is a sectional view taken generally along the line 12—12 in FIG. 11.
Figure 13:
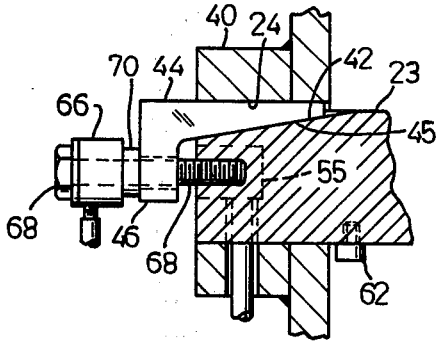
FIG. 13 is another sectional view taken generally along the line 13—13 in FIG. 11.

FIGS. 11-13 show another modification of the means for forcing the wedging means into the way slot thus securing the beam. This takes the form of another power actuated double-acting rams 66 which are mounted on a bolt means 68 threadably engaged at the end of the beam and extending freely through the downwardly extending portion of the wedge. The hollow piston 70 in the hydraulic ram 66 is withdrawn as shown in FIG. 12. In FIG. 13, it is shown as extended and bearing against the wedge to force the latter into wedging engagement between the wall and the beam. To remove the wedge, it is only necessary to retract the piston 70 thereby permitting the fluid ram 55 in the end of the beam to be extended and urge the wedging means outwardly of the way slot.

In none of the modifications is it necessary to lift the toggle beam.

I claim:

1. A jaw crusher comprising, a housing having two opposed, generally vertical side walls, means forming way slots in said walls, a movable jaw suspended within said housing, a toggle beam extending within and transversely across said housing and having a beam end projecting into each of the way slots, said beam ends having an upper surface, a toggle plate within said housing cooperating with said movable jaw and with said beam, a wedge shiftably mounted on said beam ends and in said way slots and located between said upper surfaces of said beam ends and each of said side walls, said wedges acting to wedge said beam ends downwardly in said way slots and against said side walls, and wedge shifting means connected between said wedges and said beam for forceably removing said wedge laterally outwardly from said way slots and also for forceably moving said wedge into said way slots.

2. The crusher set forth in claim 1 further characterized by said wedges including a tapered surface abuttable against a correspondingly shaped surface on said beam.

3. The crusher set forth in claim 2 further characterized in that said wedge has a downwardly extending portion, said shifting means being engageable with said downwardly extending portion of said wedge.

4. The crusher set forth in claim 3 further characterized in that said shifting means includes a fluid actuated cylinder and ram located within said beam and extending outwardly to engage said wedge.

5. The crusher set forth in claim 4 further characterized in that said shifting means also includes bolt means threadably engaged in said beam and passing through said downwardly extending portion of said wedge and including spring means acting between said wedge and said bolt means to bias said wedge into wedging engagement between said wall and said beam.

6. A jaw crusher comprising, a housing having two opposed, generally vertical side walls, means forming way slots in said walls, a movable jaw suspended within said housing, a toggle beam extending within and transversely across said housing and having ends with tapered upper surfaces forming a tapered beam end projecting into each of the way slots, a toggle plate within said housing cooperating with said movable jaw and with said beam, a tapered wedge shiftably mounted on said tapered upper surface and located between said tapered beam ends and each of said side walls and extending into said way slots and wedging said beam downwardly in said way slots and against said side walls, said wedges having a downwardly extending portion, a wedge shifting fluid actuated ram connected between said downwardly extending portion of said wedges and said beam for forceably removing said wedge laterally outwardly from said way slots, and wedge-securing means for forceably moving said wedge into said way slots.

7. The crusher set forth in claim 6 further characterized in that said wedge-securing means includes bolt means threadably engaged in said beam and passing through said downwardly extending portion of said wedge and having spring means acting between said wedge and said bolt means to bias said wedge into wedging engagement between said wall and said beam.

8. In combination with a jaw crusher having a housing and means forming a pair of opposed way slots in said housing, a toggle beam extending within and traversely across said housing and having a beam end projecting into each of the way slots, a wedge shiftably mounted on top of said beam ends and between said beam ends and said housing and extending into said way slots and wedging said beam downwardly in said way slots and against said side walls, and wedge shifting means for forceably removing said wedge outwardly from said way slots.

9. The crusher set forth in claim 8 further characterized in that wedges include a tapered surface abuttable against a correspondingly shaped surface on an upper side of said beam.

10. The crusher set forth in claim 8 further characterized in that said wedge has a downwardly extending portion, said shifting means being engageable with said downwardly extending portion of said wedge.

11. The crusher set forth in claim 10 further characterized in that said shifting means includes a fluid actuated ram located within said beam and extending outwardly to engage said wedge.

12. The crusher set forth in claim 10 including bolt means threadably engaged in said beam and passing through said downwardly extending portion of said wedge and including spring means acting between said wedge and said bolt means to bias said wedge into wedging engagement between said housing and said beam.

13. The crusher set forth in claim 11 including bolt means threadably engaged in said beam and passing through said downwardly extending portion of said wedge and including spring means acting between said wedge and said bolt means to bias said wedge into wedging engagement between said housing and said beam.

14. In combination with a jaw crusher having a housing and means forming a pair of opposed way slots in said housing, a toggle beam extending within and transversely across said housing and having ends with tapered upper surfaces which form tapered beam ends projecting into said way slots, a tapered wedge shiftably mounted on said tapered upper surfaces and between said beam ends and said housing and extending into said way slots and wedging said beam downwardly in said way slots and against said side walls, and a fluid actuated ram for shifting said wedge to forceably remove said wedge laterally outwardly from said way slots.

15. The crusher set forth in claim 14 further characterized in that said ram is located within said beam and extends outwardly to engage said wedge.

16. The crusher set forth in claim 15 including bolt means threadably engaged in said beam and passing through said wedge and including spring means acting between said wedge and said bolt means to bias said wedge into wedging engagement between said housing and said beam.

* * * * *